United States Patent [19]

Pollmeier et al.

[11] 4,226,197

[45] Oct. 7, 1980

[54] SEWING MACHINE WITH EDGE GUIDE

[75] Inventors: Konrad Pollmeier, Bielefeld; Wilhelm Thesing, Haibach, both of Fed. Rep. of Germany

[73] Assignee: Dürkoppwerke GmbH, Bielefeld, Fed. Rep. of Germany

[21] Appl. No.: 884,807

[22] Filed: Mar. 9, 1978

[30] Foreign Application Priority Data

Mar. 10, 1977 [DE] Fed. Rep. of Germany ..... 2710418

[51] Int. Cl.[2] ..... D05B 19/00; D05B 35/10

[52] U.S. Cl. ..... 112/121.11; 112/153; 112/308

[58] Field of Search ..... 112/121.11, 153, 235, 112/205, 203, 303, 306, 308, 151

[56] References Cited

U.S. PATENT DOCUMENTS

| | | | |
|---|---|---|---|
| 2,781,008 | 2/1957 | Nielsen | 112/235 X |
| 3,182,619 | 5/1965 | Sally | 112/153 X |
| 3,370,559 | 2/1968 | Longcore | 112/235 |
| 3,613,608 | 10/1971 | Hinerfeld | 112/121.11 X |
| 3,970,014 | 7/1976 | Chano et al. | 112/121.11 |
| 3,972,598 | 8/1976 | Kunz | 350/299 X |
| 4,092,937 | 6/1978 | Landau, Jr. et al. | 112/121.11 |

*Primary Examiner*—Peter P. Nerbun
*Attorney, Agent, or Firm*—Karl F. Ross

[57] ABSTRACT

A sewing machine having an edge guide for producing a stitched seam along an edge of a workpiece terminating at another edge forming an angle with the first has an optical device for directing a pencil or beam of light toward a reflective surface which underlies the workpiece and is covered thereby until the movement of the workpiece exposes the reflective surface at this other edge. The optical detector then produces a signal for initiating a control function, e.g. the change of stitch pattern to tie off the end of the previously sewn seam or to lodge the needle in the fabric so that the workpiece may be turned to bring the other edge into contact with the edge guide. The control system can include a programmer for the successive stitching operations which are initiated in succession in response to the optical sensor.

8 Claims, 6 Drawing Figures

FIG.1
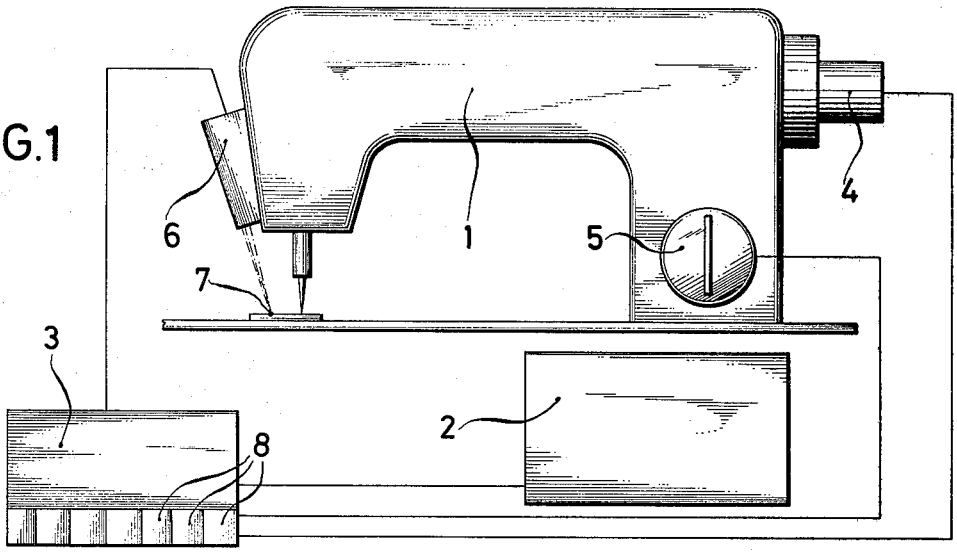
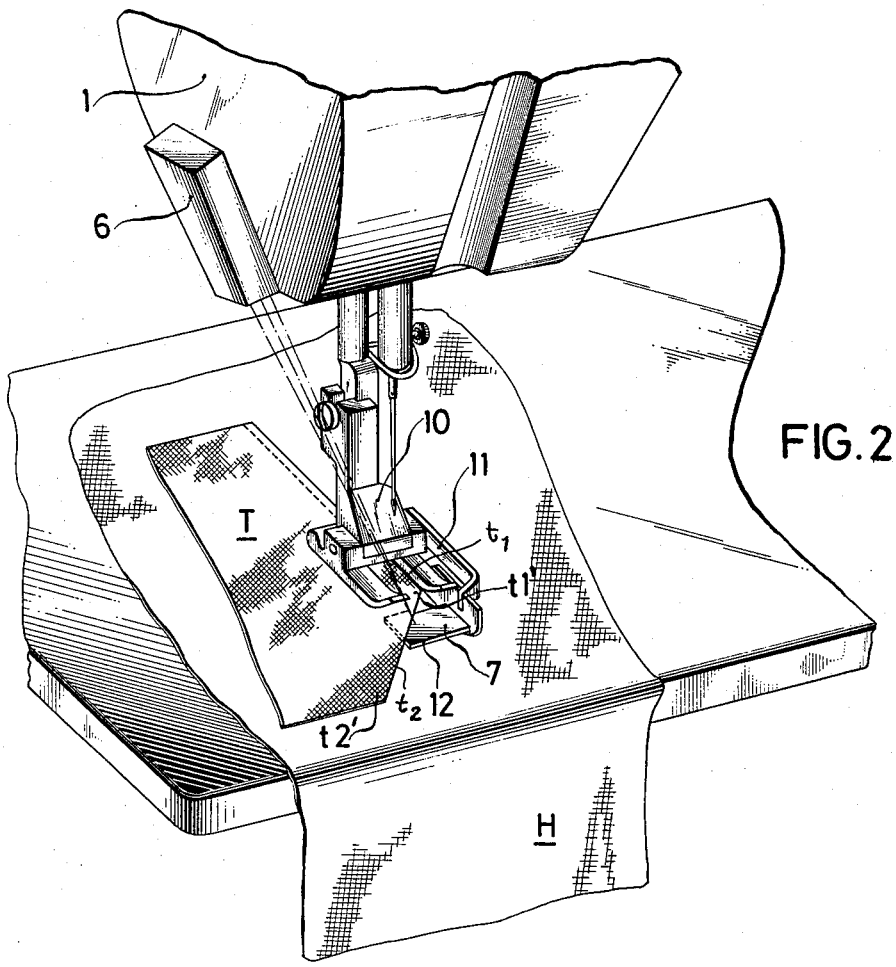
FIG.2

SEWING MACHINE WITH EDGE GUIDE

FIELD OF THE INVENTION

The present invention relates to a sewing machine having an edge guide and, more particularly, to a sewing machine provided with means for sensing the completion of one stitch seam so as to initiate subsequent operations, e.g. the tying off of the previously formed stitch seam, the turning of the workpiece, the commencement of another stitch seam, etc.

BACKGROUND OF THE INVENTION

Sewing machines have been provided heretofore with edge guides along which a fabric workpiece is displaced automatically or semiautomatically until the end of the seam or edge of a fabric workpiece is reached. Thereafter, it is usually necessary to effect a different type of sewing operation, e.g. stitching in place to bind off the previously formed seam, or begin the stitching of another seam angularly adjoining the first.

Such sewing machines can be used, for example, for the sewing of relatively small fabric pieces having angularly adjoining edges or corners to larger workpieces. A case in point is the sewing of a pocket to a shirt front with stitch seams along several sides of the pocket.

In such sewing machines it is known to provide a control device which generates an optical pulse as each corner is reached, i.e. when the stitching along one edge of the small workpiece reaches a corner. This pulse can trigger a setting function such as the stopping of the machine with its needle extending through the workpieces, to facilitate turning of the latter so that the next edge to be seamed engages the edge guide. The machine is then turned on again and permitted to sew a new seam along the latter edge. In other words, the control means provides means responsive to the optical sensor for performing a control function related to the stitching operation. A machine of this type is described in German published application (Auslegeschrift) DT-AS No. 1 302 988.

In this system, the optical pulse is generated by an electro-optical sensor which responds to a reflection from an indexing point or mark upon the surface of a template mounted upon the workpiece or provided upon the surface of the workpiece itself.

Naturally, the requirement for an extra piece, such as a template, is disadvantageous in that templates must be provided and stored for each of the many sizes and shapes of the workpieces to be stitched. The application of a reflecting marking point to the workpiece has the disadvantage that it requires an additional operation and hence increases the labor costs of the sewing operation.

OBJECTS OF THE INVENTION

It is the principal object of the present invention to provide a sewing machine, especially for the stiching of small workpieces to larger workpieces or substrates along a plurality of angularly adjoining edges, whereby the disadvantages of the earlier systems described above can be obviated and precise control of the operation can be effected without additional marking operations and without the need for a stock of templates and the like.

Another object of the invention is to provide an improved control system for a sewing machine such that, upon termination of the stitching of a substantially linear seam, a selected one of several possible successive operations can be effected with a high degree of precision and a minimum of manipulative steps.

It is also an object of the invention to provide a sewing machine and control device capable of triggering a stitch-controlling or setting function upon the edge-parallel stitching of a first seam upon reaching a corner of a workpiece which is to be sewn to a substrate or ground fabric.

Yet another object of our invention is to provide a control system capable of accurately monitoring a succession of stitching operation for the sewing of a polygonal workpiece to an underlying workpiece without requiring the application of marking points to the fabrics or the use of templates, and which system is sufficiently versatile so as to be useful for a wide variety of sizes and shapes of the polygonal workpiece.

SUMMARY OF THE INVENTION

These objects and others which will become apparent hereinafter are attained, in accordance with the present invention, in a sewing machine for the stitching of edge-true rectilinear stitch seams along the edges of a polygonal workpiece having angularly adjoining edges defining corners between some of the successive seams (e.g. a pocket piece to be attached to a shirt or blouse front) using a control device responsive to the movement of the corner to a predetermined location with respect to the stitching location. The control device includes means responsive to the impulse of the corner sensor for triggering a subsequent sewing operation in the manner described previously.

According to an essential feature of the invention, the sewing machine is provided with a lug extending transversely to the stitching direction and to a line extending the edge guide and disposed ahead of the stitching location in the direction of the workpiece feed, the upper side of this lug being provided as a reflective surface upon which a beam or pencil of light is trained. The workpiece which is to be stitched in an edge-parallel manner is guided over this lug until the corner passes it and exposes the reflective surface to enable reflection of the beam and the detection of the reflected beam so as to generate the aforementioned pulse for initiating a subsequent stitching operation or setting function.

According to a feature of the invention, the control circuit or system includes a program memory whereby a predetermined succession of operations can be stored and set with each such pulse initiating the next operation of the sequence.

BRIEF DESCRIPTION OF THE DRAWING

The above and other objects, features and advantages of the present invention will become more readily apparent from the following description, reference being made to the accompanying drawing in which:

FIG. 1 is a side-elevational view of a sewing machine provided with a control system in accordance with the present invention, in highly diagrammatic form;

FIG. 2 is a side perspective view, from above and somewhat toward the front of the machine illustrating the relationship of the edge guide, light beam and reflective lug.

SPECIFIC DESCRIPTION

Figure 3:
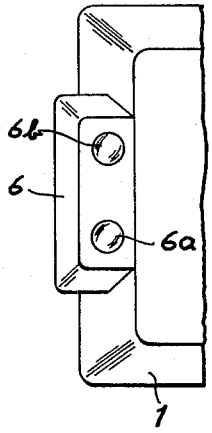
FIG. 3 is a bottom view of the optical sensor of the apparatus of FIGS. 1 and 2.

The sewing machine 1 (FIGS. 1 and 2) has a drive motor 2 which operates the machine in the usual manner. The motor 2 drives the needle-positioning and needle-reciprocating device 4 through a programmer 3 which is also effective to control a stitch-setting knob 5 of the sewing machine. The stitch-setting knob 5 permits changeover from the seam stitch to the lock stitches at each end of the seam.

The head of the sewing machine 1 includes a reflection sensor 6 which may be provided with its own light source as will be described in greater detail below or which can include only an optical detector focused upon the reflective surface 7 of a lug 12. When the sensor 6 does not make use of a light source, the normal sewing machine light, e.g. from a lamp mounted above the sewing location, is reflected to the light detector as shown in broken lines in FIGS. 1 and 2.

When the reflected light is detected, this is an indication that the corner of the fabric workpiece has exposed the surface 7 so that a pulse is applied to the control device 3 to initiate the next-selected setting function after a predetermined number of further stitches is produced. This further setting function which can be selected on the programmer 3 by operation of the selector keys 8, can be the formation of a lock stitch to terminate the seam (by operation of the stitch selector 5), followed by an operation of the needle positioner 4 to retain the needle in the fabric and enable the latter to be turned about the needle for the stitching of the next seam. The next function is then ordinary seam formation and, since the reflective surface is again covered, the process continues until the surface 7 is exposed.

As can be seen from FIG. 2, the sewing machine 1 is provided with a presser foot 10 which is formed with an edge guide 11 extending in the direction of fabric feed. The workpieces, in this case a six-sided breast pocket T which is to be sewn upon a shirt front H, are engaged between the presser foot and the stitch plate which can have the usual fabric feed teeth or dogs. The edge $t_1$ of the pocket T is guided linearly along member 11.

Transverse to the edge guide 11 and to a line extending same beyond the stitching location, there is provided a lug 12 which is formed with a bright or polished reflective upper surface 7 as described. This lug 12 is covered by the pocket piece T until the stitch seam $t_1$ is completed and the corner $t_1'$ between this edge and the edge $t_2$ exposes the surface 7. The light is reflected to the sensor 6 to trigger the pulse and the operation described.

When the needle is held briefly in the workpiece and the fabric H with the pocket piece T are rotated through 45° therearound, the reflective surface is again covered and the next seam $t_2$ can be stitched until the corner $t_{2'}$ is reached. The process is again repeated until the pocket has been fully attached.

The application of the lug 12 to the edge guide 11 of the presser foot 10 has been found to be especially compact and convenient, although the principles of this invention are applicable to any edge-guide arrangement.

Figure 6:
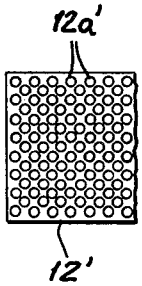
FIG. 6 is a plan view of a portion of the lug of FIGS. 1 and 2, shown in greatly enlarged but diagrammatic form.

FIG. 3 shows that the sensor 6 can include a light projector 6*a* as well as a photocell 6*b*. In this case, the projector 6*a* trains a focused beam of light upon the surface 7 and the photocell is likewise focused on the surface 7 to pick up reflected light when the surface is uncovered by the pocket piece T. To insure at least partial reflection to its photocell, the surface of the lug can be provided, as shown for the lug 12' in FIG. 6, with a multiplicity of facets 12*a*'.

Alternatively, a portion of the lug 12 may be bent at 12*a* so that this portion of the surface 7 lies perpendicular to the axis $A_2$ etc. of the beams.

Figure 5:
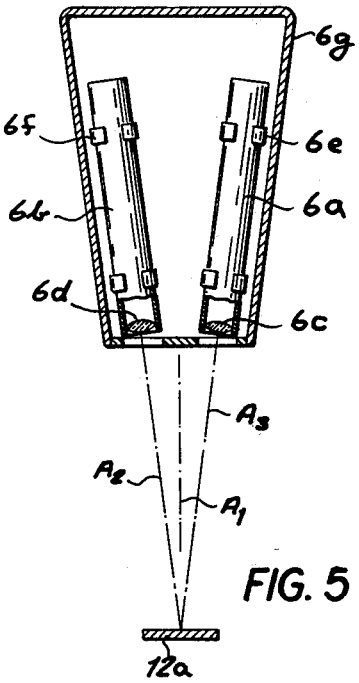
FIG. 5 is a cross-sectional view taken along the line V—V of FIG. 4.
Figure 4:
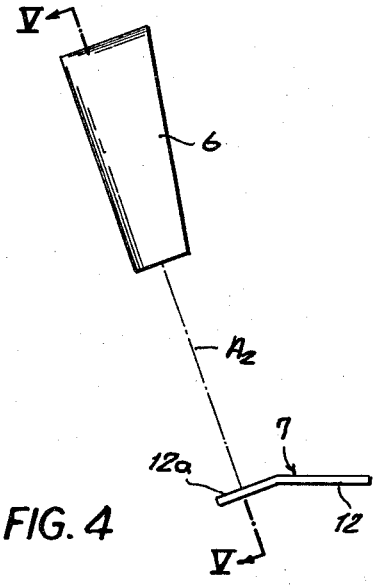
FIG. 4 is a diagrammatic detail view illustrating principles of the invention.

A preferred construction of this embodiment of the sensor of the present invention has been shown diagrammatically in FIG. 5 in which the sensor is shown to have a housing 6*g* provided with clips 6*e* and 6*f* receiving respectively the element 6*a* and 6*b* previously described. These elements each have focusing lenses as shown at 6*c* and 6*d* respectively. The projected pencil of light and the reflected pencil of light have axes $A_3$ and $A_2$ which are coplanar with a perpendicular $A_1$ to the surface 7 of the lug 12*a*. This system, of course, operates similarly to the system previously described.

We claim:

1. A sewing machine for the edge-parallel stitching of a workpiece having a pair of angularly adjoining edges, said sewing machine comprising:
   - a sewing machine head having a needle adapted to stitch a seam in said workpiece along each of said edges upon displacement of said workpiece past said needle at a stitching location;
   - an edge guide engageable with the edges of said workpiece for guiding same past said location;
   - reflection sensor means on said sewing machine head trained at a location ahead of said stitching location;
   - control means responsive to said sensor means for stopping said needle in said workpiece upon a completion of a seam along a first edge of said workpiece, thereby facilitating the turning of said workpiece to align a second edge with said edge guide; and
   - a lug having a reflective upper surface extending transversely from said edge guide ahead of said needle and covered by said workpiece until exposed to activate said sensor.

2. The sewing machine defined in claim 1 wherein said control means includes programming means for storing a succession of sewing machine operations to be initiated successively in response to said sensor.

3. The sewing machine defined in claim 2 wherein said programming means includes selector means for establishing said operations in said programming means.

4. The sewing machine defined in claim 1 wherein said sensor includes a housing having a photocell mounted on said head, said photocell being provided with a lens focused on said upper surface of said lug.

5. The sewing machine defined in claim 4, further comprising a lamp in said housing trained on said lug.

6. The sewing machine defined in claim 4 wherein said head is provided with a presser foot, said edge guide and said lug being formed on said presser foot.

7. A sewing machine for at least semi-automatically stitching a workpiece, comprising:
   - a sewing-machine head carrying a reciprocating needle adapted to stitch a seam in said workpiece upon the displacement thereof past said needle at a stitching location;

guide means on said sewing machine engageable with said workpiece for guiding same past said stitching location;

light-sensing means on said sewing machine trained on a reflection location ahead of said stitching location;

control means operationally connected to said needle and to said light-sensing means for regulating, in response to signals therefrom, the stitching of said workpiece by said needle; and a lug at said reflection location, said lug being attached to said guide means and having a multiply faceted reflective surface covered by said workpiece until exposed to activate said light-sensing means.

8. A sewing machine as defined in claim 7 wherein said guide means includes an edge guide, said surface extending transversely to said edge guide, said control means including programming means for stopping said needle in said workpiece upon the completion of a seam along a first substantially rectilinear edge of said workpiece, thereby facilitating the turning thereof to align with said edge guide a second rectilinear edge adjoined to said first edge at an angle.

* * * * *